US009316013B1

(12) United States Patent
Kraft

(10) Patent No.: US 9,316,013 B1
(45) Date of Patent: Apr. 19, 2016

(54) CONCEALED SHELTER

(71) Applicant: Bunker Safety Structures, LLC, Edmond, OK (US)

(72) Inventor: Joe Kraft, Edmond, OK (US)

(73) Assignee: Bunker Safety Structures, LLC, Edmond, OK (US)

( * ) Notice: Subject to any disclaimer, the term of this patent is extended or adjusted under 35 U.S.C. 154(b) by 0 days.

(21) Appl. No.: 14/617,535

(22) Filed: Feb. 9, 2015

Related U.S. Application Data

(60) Provisional application No. 61/937,512, filed on Feb. 8, 2014.

(51) Int. Cl.
*E02D 27/00* (2006.01)
*E04H 9/12* (2006.01)
*E02D 29/045* (2006.01)

(52) U.S. Cl.
CPC ..... *E04H 9/12* (2013.01); *E02D 29/045* (2013.01)

(58) Field of Classification Search
CPC ..... E04H 9/12; E04H 9/14; E02D 29/045
USPC ..... 49/246, 247, 2, 48, 253, 261, 254, 255
See application file for complete search history.

(56) References Cited

U.S. PATENT DOCUMENTS

| | | | | |
|---|---|---|---|---|
| 3,155,057 | A * | 11/1964 | Ayres | 109/1 S |
| 3,198,094 | A * | 8/1965 | Dunkerley | 49/67 |
| 4,660,334 | A * | 4/1987 | McCarthy | 52/169.6 |
| 5,115,613 | A * | 5/1992 | McCarthy | 52/169.6 |
| 6,438,907 | B1 * | 8/2002 | McCarthy | 52/169.6 |
| 8,904,709 | B2 * | 12/2014 | Ajiki | 312/319.2 |
| 2002/0046515 | A1 * | 4/2002 | McCarthy | 52/169.6 |
| 2002/0124490 | A1 * | 9/2002 | McCarthy | 52/169.6 |
| 2003/0167708 | A1 * | 9/2003 | Shaw et al. | 52/169.6 |
| 2006/0032154 | A1 * | 2/2006 | Johnson | 52/36.1 |
| 2007/0022678 | A1 * | 2/2007 | Sempel | 52/169.6 |
| 2008/0172954 | A1 * | 7/2008 | Cravens | 52/169.6 |

* cited by examiner

*Primary Examiner* — Brian Glessner
*Assistant Examiner* — Gisele Ford
(74) *Attorney, Agent, or Firm* — Hall Estill Attorneys At Law

(57) ABSTRACT

An apparatus and associated method contemplating an underground shelter having an open-top enclosure and a base. A linkage assembly selectively moves the base between an opened position and a closed position. A lifting mechanism lifts the base in opposition to a force of gravity on the base in the opened position. A concealment object is supported upon the base to conceal the existence of the underground shelter below.

1 Claim, 8 Drawing Sheets

CONCEALED SHELTER

RELATED APPLICATIONS

The current application claims priority to the U.S. Provisional Application Ser. No. 61/937,512 filed Feb. 8, 2014.

BACKGROUND

Technological advancements have made personal ownership of a storm shelter more affordable, and hence more available, to the homeowner. The market for storm shelters has grown significantly; underground storm shelters and safe rooms are much more prevalent in new home construction in recent years. There is a market demand for a concealed underground shelter, be it for safe retreat from a storm and/or for the concealed underground storage of valuables such as guns and ammunitions, other valuables, and survival rations such as food, water, medicines and the like. This demand comes from a steady and recent rise in global societal/political turmoil, unrest, threat of war, coupled with the economic instability of major countries around the world. A result is a group of citizens generally referred to as "preppers," named for the fact that they are preparing for economic and social unrest of varying predicted degrees. This market demand is satisfied by an underground shelter that, when closed, is advantageously concealed to the view of others above ground. It is to these improvements that the embodiments of the present invention are directed.

SUMMARY

Some embodiments of this technology contemplate an underground shelter having an open-top enclosure and a base. A linkage assembly selectively moves the base between an opened position and a closed position. A lifting mechanism lifts the base in opposition to a force of gravity on the base in the opened position. A concealment object is supported upon the base to conceal the existence of the underground shelter below.

BRIEF DESCRIPTION OF THE DRAWINGS

Details of various embodiments of the present invention are described in connection with the accompanying drawings that bear similar reference numerals.

DESCRIPTION

The presently disclosed technology contemplates an underground shelter having an enclosure with an open top. The shelter also has a lid that is selectively moved to a closed position to close the enclosure. The lid includes an above-ground object not normally associated with an underground shelter, in order to conceal the existence of the underground shelter when the lid is closed.

For purposes of this disclosure certain embodiments are described in which the enclosure is constructed of concrete, and preferably of a monolithic concrete pour made possible by the use of a modular form system. That modular form system is included in the disclosure of Applicant's previously filed provisional application Ser. No. 61/892,201 filed on Oct. 17, 2013 which is assigned to the assignee of this application and which is incorporated herein in its entirety.

Figure 1:
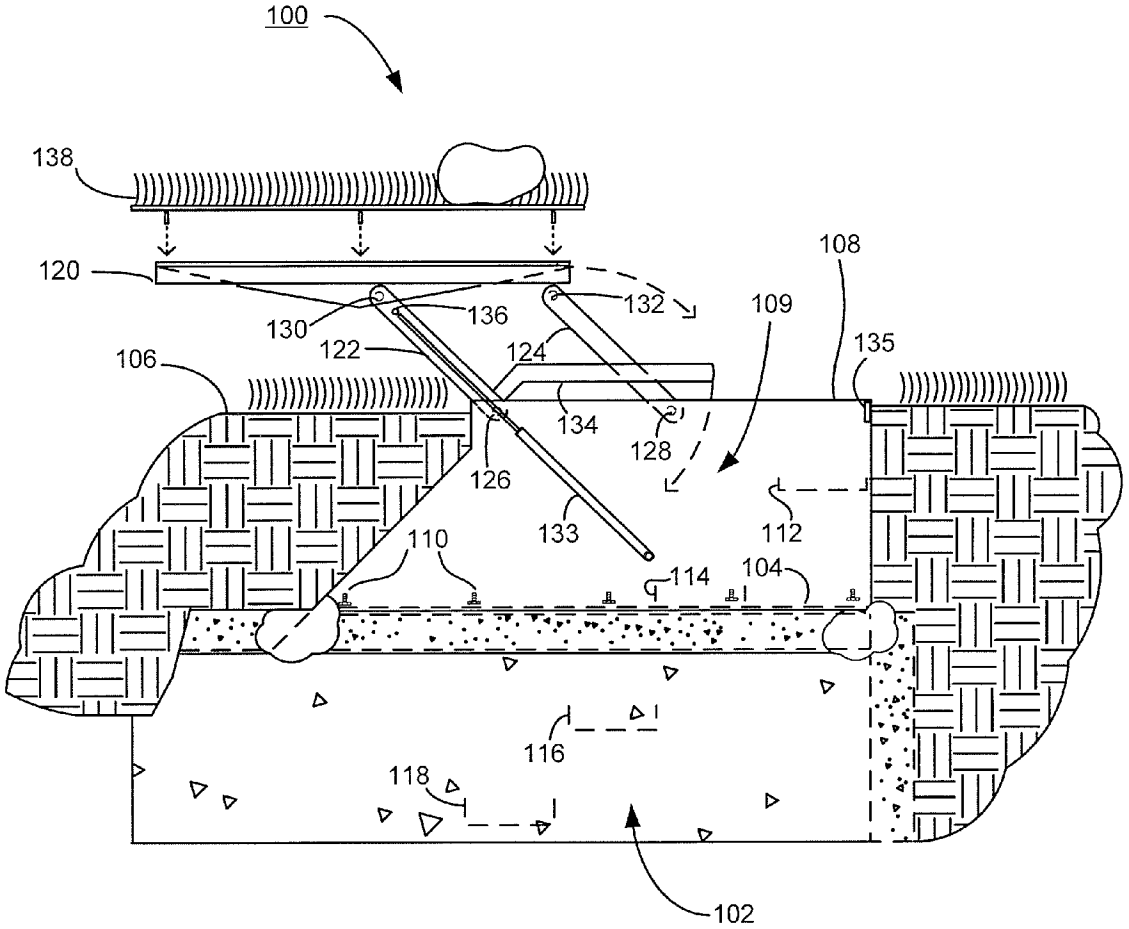
FIG. 1 diagrammatically depicts a side view of an underground shelter in the opened position that is constructed in accordance with embodiments of the present invention.

FIG. 1 diagrammatically depicts a side view of a shelter 100 that is constructed in accordance with illustrative embodiments of the present invention. The shelter 100 depicted in FIG. 1 is in the opened position, such that a user can enter or leave the shelter via an exposed entry 109. To construct the enclosure 102, first an oversize trench is excavated and then concrete forms are placed inside the trench. Concrete can then be poured against the forms. When the concrete is sufficiently cured the forms can be removed, as explained below in more detail, exposing the cured concrete in its formed shape of an open-top enclosure 102.

In these illustrative embodiments the top edge 104 of the open top enclosure 102 is formed below grade 106. A shroud 108 is attached to a portion of the top edge 104, such as by the plurality of fasteners 110 embedded in the concrete. The shroud 108 generally forms an accessible entry 109 through which users can readily pass to enter or leave the shelter 100. The shroud 108 can be constructed of structural components that are formed and/or welded metal components, composite material components, and the like. The height of the shroud 108 can be related to the number of steps that are traversed to reach the top edge 104 of the enclosure 102. Typically, a stair rise of about 9.5 inches is specified for an ergonomically effective stairway. Here, there are two steps 112, 114 supported by the shroud 108 and used to stand partially within the entry 109. Thus, in these depicted embodiments the shroud 108 is about nineteen inches high. Additional steps 116, 118 supported by the enclosure 102 are used to stand partially within the enclosure 102 when either entering or leaving the shelter 100.

Figure 2:
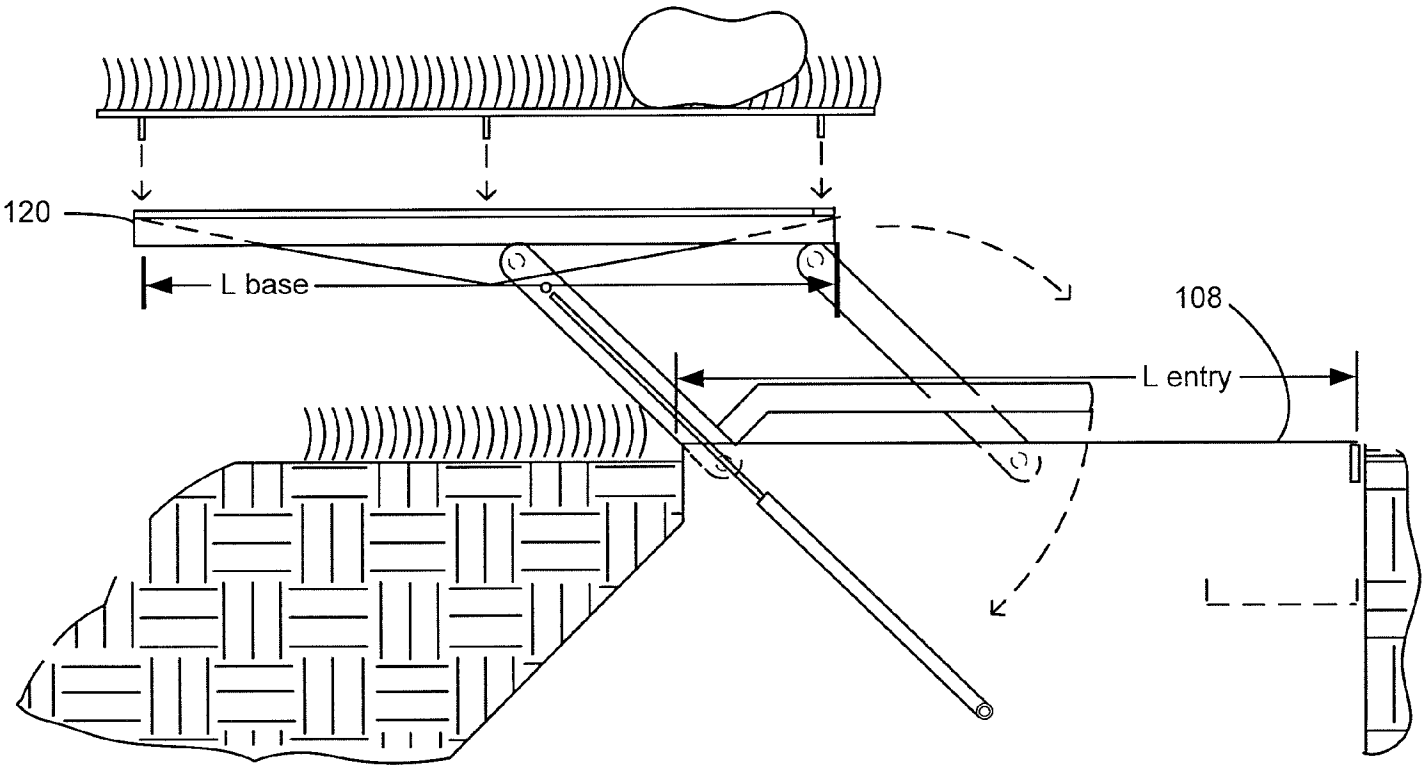
FIG. 2 is an enlarged detail of a portion of the shelter of FIG. 1.

FIG. 2 is an enlarged detail of a portion of FIG. 1. The entry 109 in these illustrative embodiments is rectangular, having a longitudinal length depicted by "$L_{entry}$." That $L_{entry}$ corresponds to the size of a base 120 having a longitudinal length "$L_{base}$" such that in the closed position (FIG. 3) the base 120 sealingly engages against the shroud 108 to close the entry 109. A seal can be attached to either the base 120 or the shroud 108, or both. The base 120 is latched in a closed position that compressingly engages the seal to seal the enclosure 102 from exterior moisture, debris, and animal invaders.

Returning to FIG. 1, each side of the base 120 is supported by two links 122, 124 that are connected to the shroud 108 at respective lower ends by pins 126, 128, and that are connected to the base 120 at respective upper ends by pins 130, 132. A lifting mechanism 133 exerts a lifting force to lift the base 120, and whatever is supported by the base as discussed below, against the force of gravity. In the depicted embodiments the lifting mechanism 133 is a gas shock, although the contemplated embodiments are not so limited. In alternative equivalent embodiments a spring and the like can provide the lifting force.

Importantly, the parallel links 122, 124 keep the platform 120 substantially level at all times when moving between the opened and closed positions. That permits placing a concealment object 138 on the platform 120 that has items that could be spilled or toppled if not maintained in a level orientation. The fire pit $\mathbf{138}_1$ discussed below, for example, could spill hot embers or lava rocks if it was not held level at all times. In alternative embodiments where holding the object 138 level is not essential, then other configurations for the links can be used.

Figure 3:
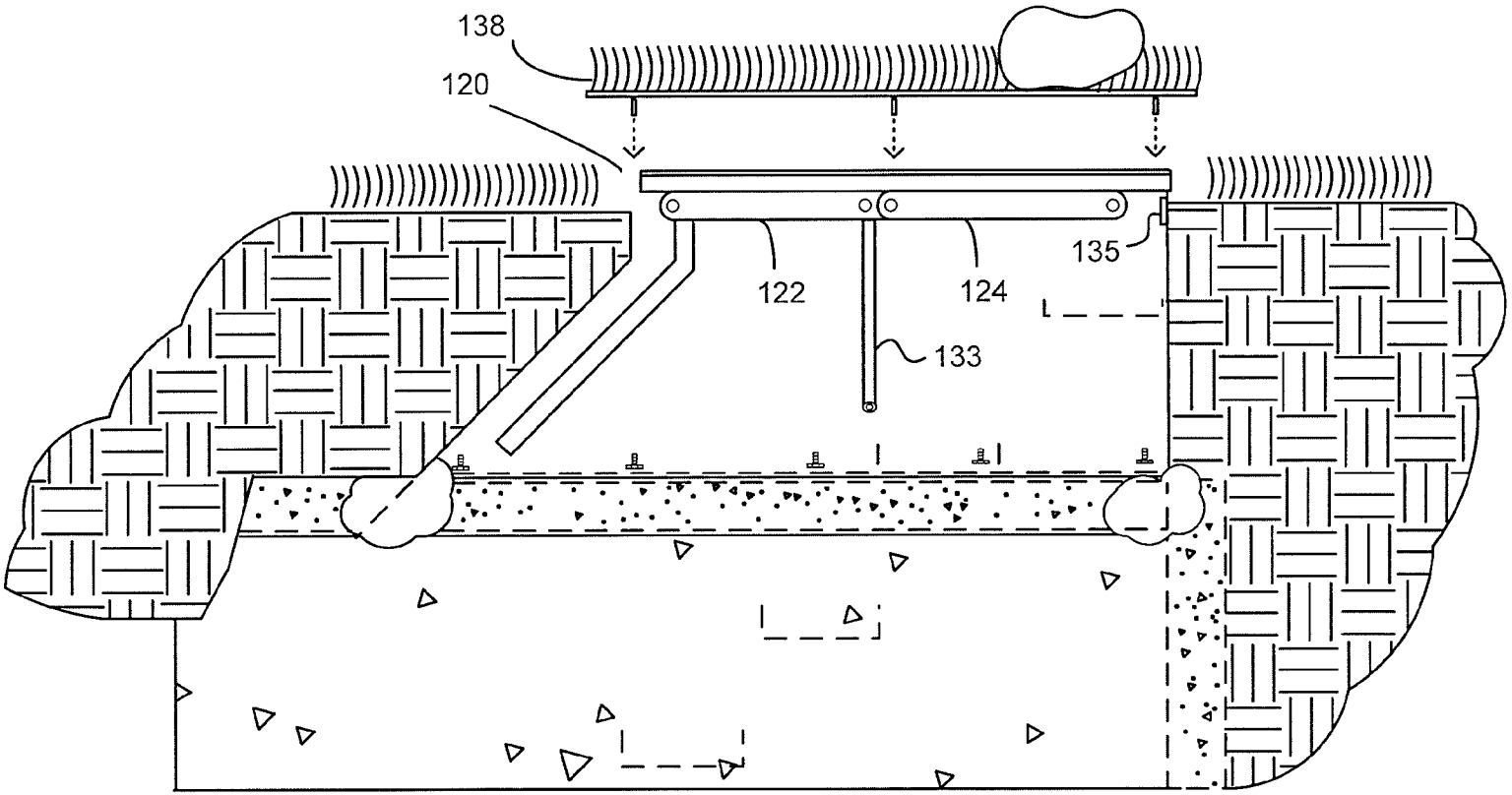
FIG. 3 depicts the shelter of FIG. 1 but in the closed position.

A lever 134 is presented to the user to grasp and rotate clockwise (push/pull downward) to rotate the link 122, and in turn the base 120, in a clockwise direction. The other link 124 passively rotates likewise in the clockwise direction. When the links 122, 124 rotate past the vertical position, the force of gravity assists the base 120 (and whatever it supports) in lowering until it ultimately can be latched in the closed position, sealingly engaging against the top end of the shroud 108. The gas shock 133 in these illustrative embodiments advantageously provides resistance against the downward movement to prevent the base 120 from slamming shut on the shroud 108. FIG. 3 is a view similar to FIG. 1 but depicting after the base 120 has been latched in the closed position. In the closed position the base 120 has a catch (not depicted) that engages a latch 135 to resist the opening force of the lifting mechanism 133. Preferably, the latch 135 is electronically actuated wirelessly so that a user can remotely actuate the latch 135 while walking toward the shelter. In the event of a transmitter failure a manual override can be provided to acutate the latch 135 if the operator has the appropriate credentials, such as by holding a key fob, to grant the operator access to actuating the latch 135.

Figure 4:
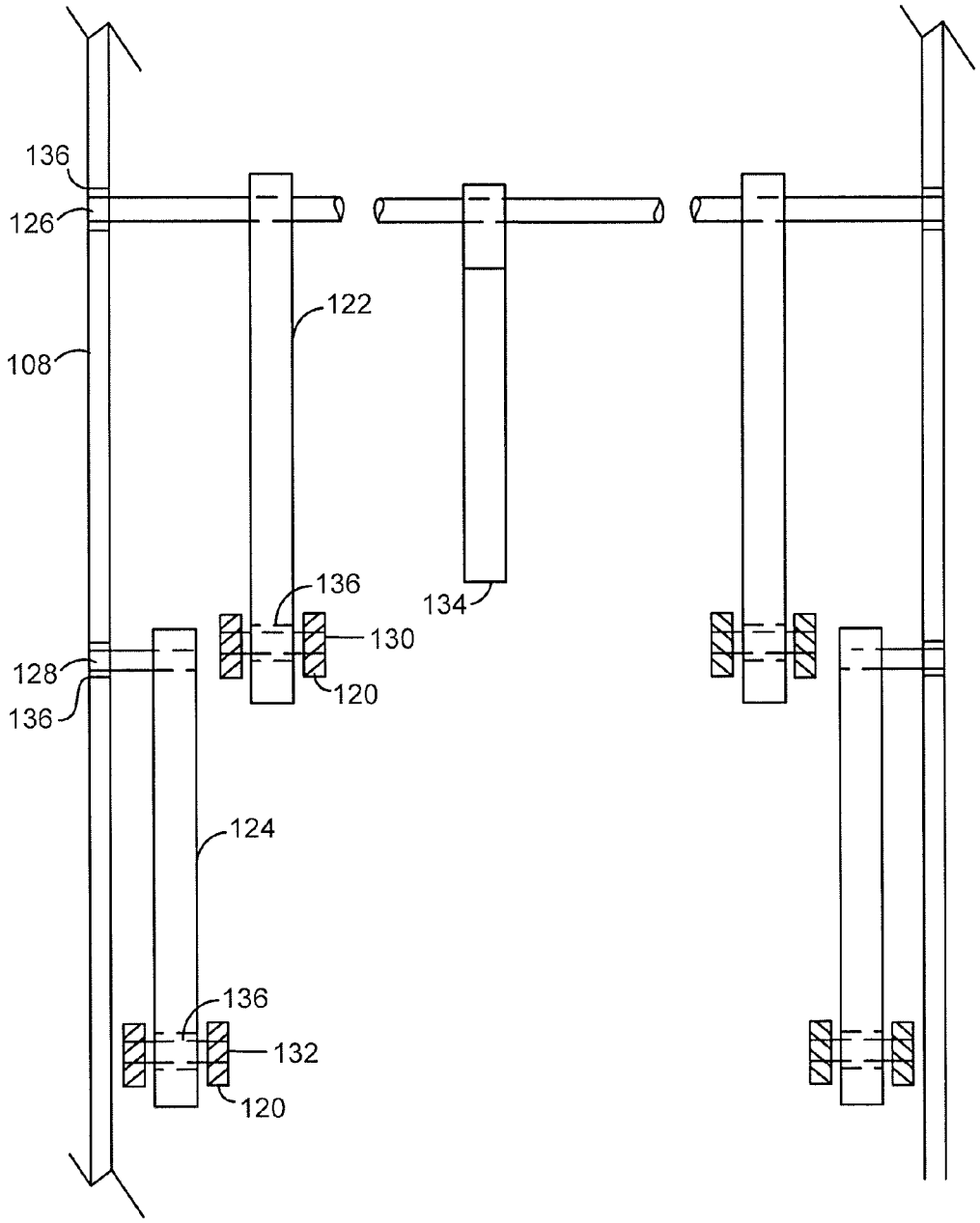
FIG. 4 depicts a partial cross sectional top view of the links nesting in the closed position.

FIG. 4 is a cross sectional view depicting how the links 122, 124 can be staggered laterally so that they can overlap longitudinally in the closed position. The pin 126 is supported in free rotation within a bearing 136 in the shroud 108. The lower end of the link 122 and the lever 134 are both rigidly affixed in rotation with the pin 126. The pins 128, 130, 132 are likewise coupled by respective bearings 136 permitting free rotation, and the lower end of the link 124 is likewise affixed in rotation with the pin 128.

In these illustrative embodiments the pin 126 can extend to span both opposing sides of the shroud 108 forming the entry 109. This permits attaching the single lever 134 as depicted, midway between the links 122, so that a force applied to the lever 134 is equally distributed to each of the links 122. In equivalent alternative embodiments (not depicted) two levers 134 can be provided, each attached closely to the respective link 122.

Figure 5:
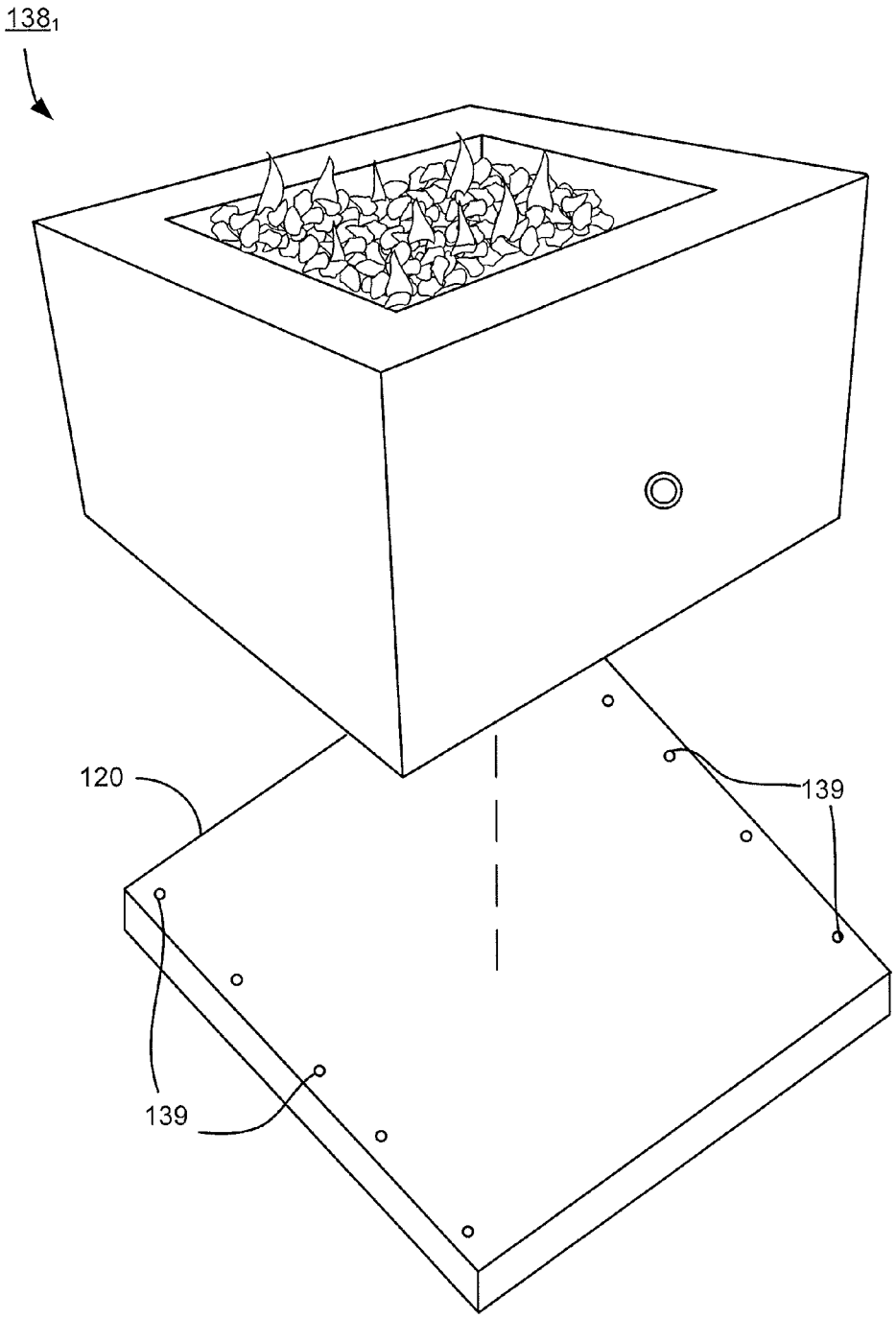
FIG. 5 is an isometric depiction of the concealment object being a fire pit.

Returning to FIG. 1, the base 120 supports an above-ground object 138 that is intended to conceal the presence of the underground shelter 100 below. That is, generally, an above ground view of the object 138 in the closed position of the shelter 100 (FIG. 3) would intentionally mislead the unknowing viewer into believing that an underground shelter 100 cannot exist beneath the object 138. For example, without limitation, FIG. 5 depicts embodiments that contemplate the object 138 being a gas fire pit $\mathbf{138}_1$. The fire pit $\mathbf{138}_1$ is attached to the top side of the base 120, such as with fasteners passing through apertures 139 in the base 120. The lifting mechanism 133 (FIG. 1) is specified according to what lifting force is necessary to lift the combined weight of the fire pit $\mathbf{138}_1$ and the base 120. The gas can be supplied via a flexible gas line to accommodate the displacement of the fire pit $\mathbf{138}_1$ when moved to the opened position. Alternatively, the gas can be supplied by a self-contained container of gas that moves with the fire pit $\mathbf{138}_1$.

Figure 6:
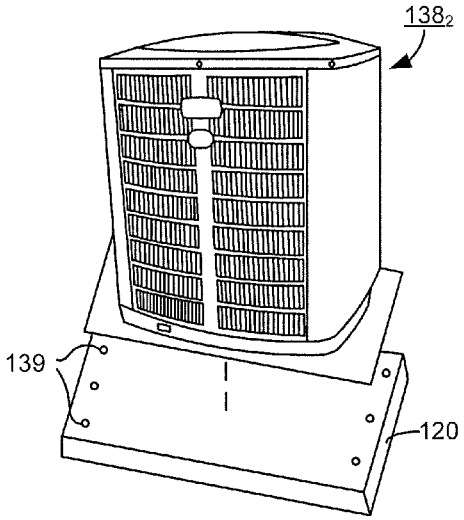
FIG. 6 is an isometric depiction of the concealment object being a condensing unit.
Figure 7:
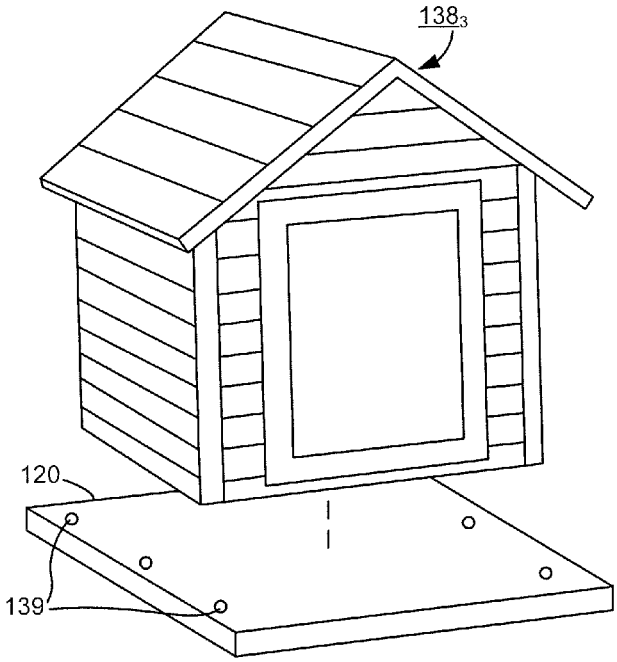
FIG. 7 is an isometric depiction of the concealment object being a dog house.

FIG. 6 depicts alternative embodiments that contemplate the object 138 being an outdoor condensing unit $\mathbf{138}_2$ in an air conditioning system. The condensing unit can be an actual functioning unit or it can be a decoy unit. In either event the power and tubing connections are made with adequate flexible loops to permit the condensing unit $\mathbf{138}_2$ to move to the opened position. FIG. 7 depicts yet other alternative embodiments that contemplate the object 138 being an outdoor dog house $\mathbf{138}_3$. The skilled artisan readily ascertains from these illustrative embodiments that the object 138, either real or decoy, is something the viewer would be accustomed to seeing in its environment but effectively concealing the fact that it is attached to the lid of the underground storage shelter 100. An enumeration of all types of such outdoor objects that can be used to perform that function is not necessary for the skilled artisan to understand the contemplated scope of the present technology.

Figure 8:
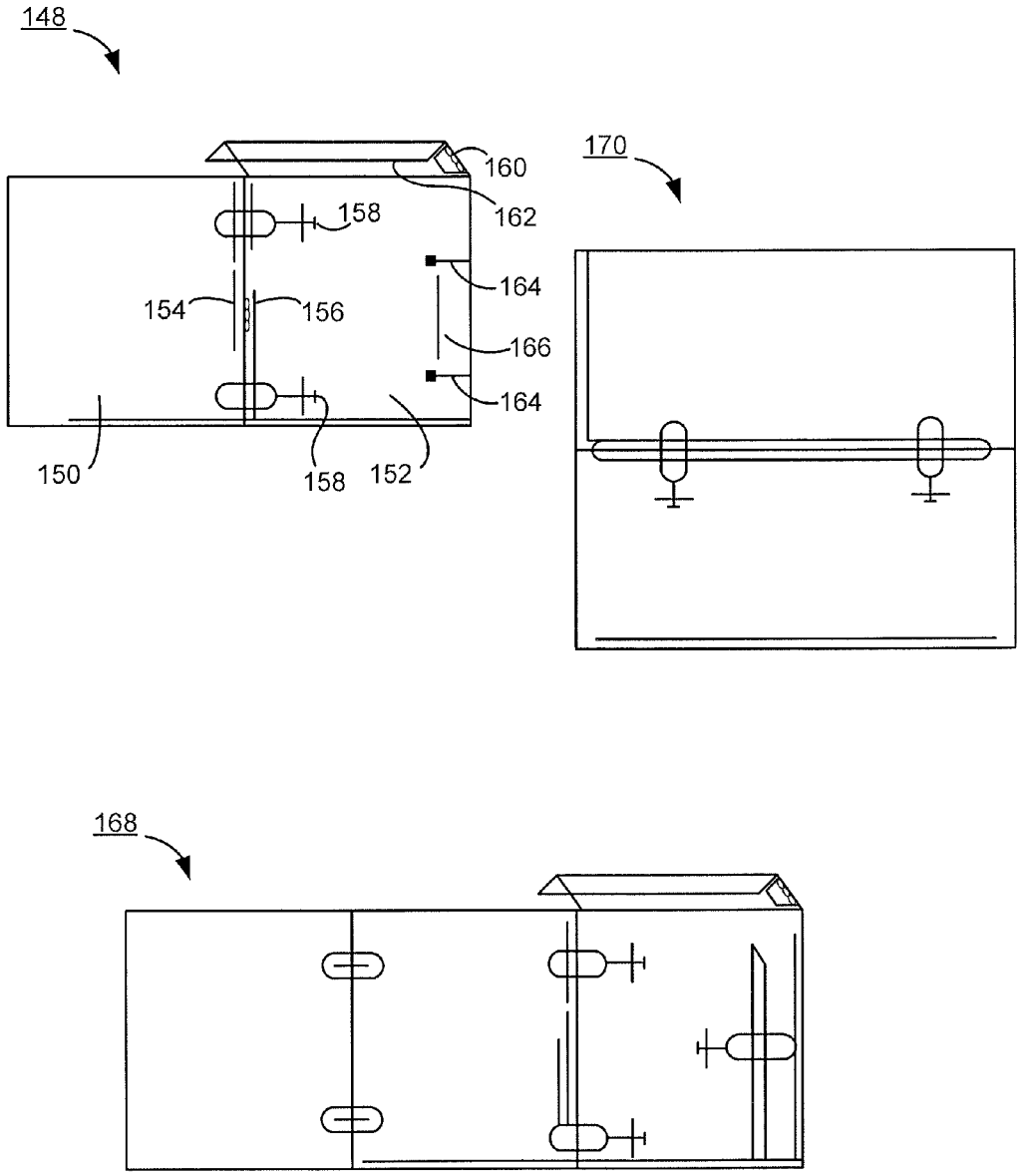
FIG. 8 depicts modular forms for constructing an underground open-top concrete enclosure that is sized to support the shroud as depicted in FIG. 1.
Figure 9:
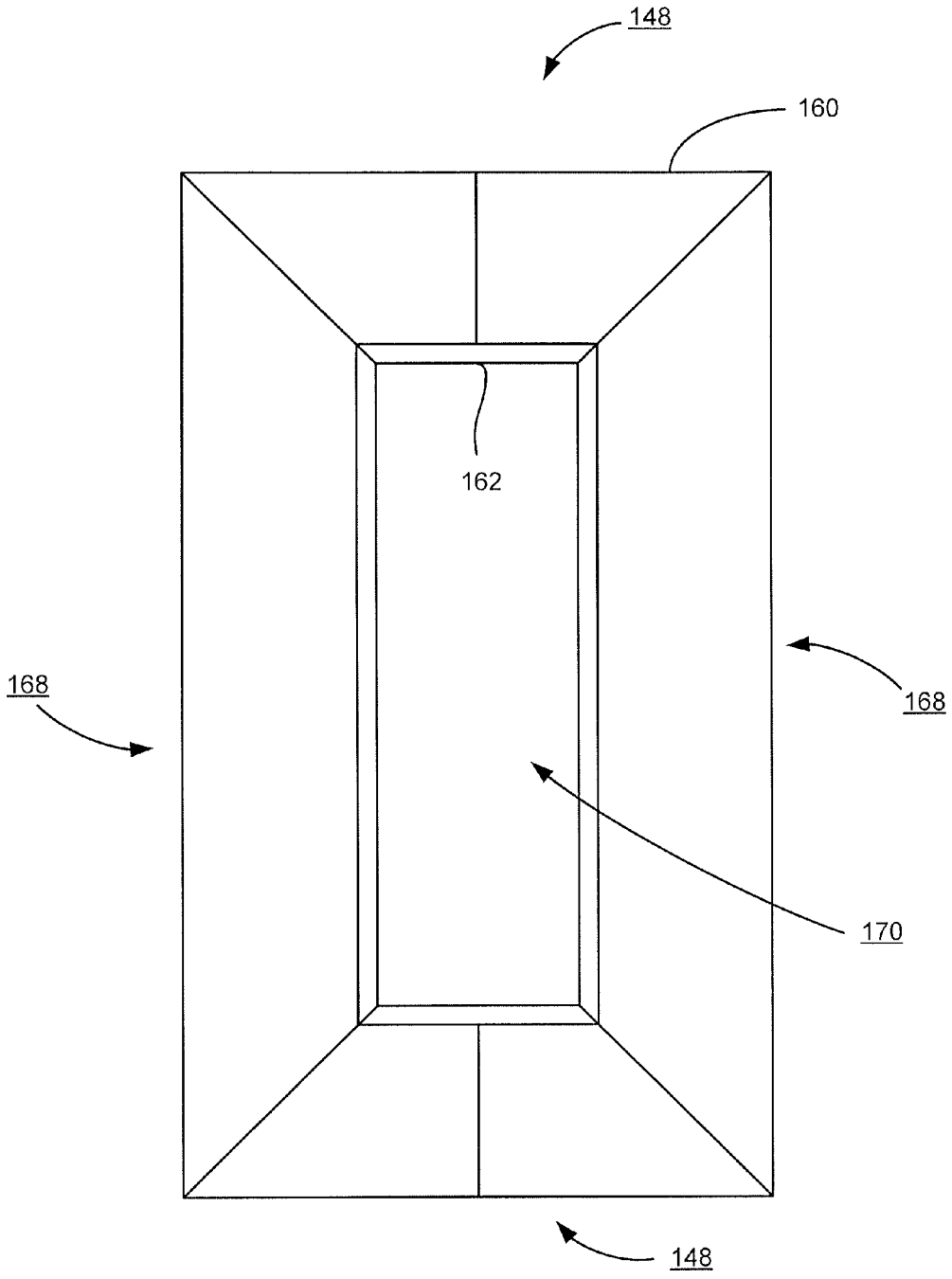
FIG. 9 depicts a top view of the concrete forms in FIG. 5 joined together for pouring the underground open-top concrete enclosure.

With further reference to the concrete enclosure 102 described in brief above, FIG. 8 depicts a modular concrete form system that is well suited for use in this technology. An end panel assembly 148 is constructed by joining two panels 150, 152 together edge-to-edge. Flanges 154, 156 at the mating edges of the panels 150, 152 provide protuberant surfaces that are well adapted for connecting together with a clamping mechanism 158, such as a c-clamp or a vise-grip and the like. A flange 160 extends substantially orthogonal to the panel 152, and another flange 162 extends substantially orthogonal to the flange 160. Although not depicted, the panel 150 likewise has two orthogonal flanges extending inwardly and downwardly, respectively. Fastening members 164 can be affixed to yet another flange 166 to matingly align with openings in a flange on the side panel assembly 168. The side panel assembly 168 and the bottom panel assembly 170 are constructed in like manner. FIG. 9 is a top view depiction of two opposing end panel assemblies 148 and two opposing side panel assemblies 168 attached to the bottom panel assembly 170. Note that the top-side orthogonal flanges such as 160, 162 abuttingly engage each other to position the panel assemblies 148, 168 squarely to the bottom panel assembly 170. Preferably, the corner flanges are diagonally shaped to provide the mitered corners depicted in FIG. 9. The completely assembled forms advantageously permit constructing all four sides and the bottom of the enclosure 102 in a monolithic pour.

In the foregoing illustrative embodiments the shelter 100 is installed so that its entry 109 is flush with grade 106. In some embodiments the grade 106 can be an existing concrete floor, such as the fire pit $\mathbf{138}_1$ (FIG. 5) installed on concrete patio and the like. In that event it is advantageous to modify the concrete enclosure 102 to provide concrete extensions upward to the grade so that the concrete enclosure 102 can be tied to the existing concrete floor. The existing concrete floor is drilled in multiple places to receive reinforcement rods (such as rebar) before pouring the enclosure 102, to tie the newly poured concrete enclosure 102 to the existing concrete floor.

The various features and alternative details of construction of the apparatuses described herein for the practice of the present invention will readily occur to the skilled artisan in view of the foregoing discussion, and it is to be understood that even though numerous characteristics and advantages of various embodiments of the present invention have been set forth in the foregoing description, together with details of the structure and function of various embodiments of the invention, this detailed description is illustrative only, and changes may be made in detail, especially in matters of structure and arrangements of parts within the principles of the present invention to the full extent indicated by the broad general meaning of the terms in which the appended claims are expressed.

What is claimed is:

1. An underground shelter comprising:

an open-top enclosure;

a base;

a linkage assembly including parallel links having respective first ends that are connected to laterally staggered pivots on the enclosure, thereby configured to selectively move the base between an opened position and a closed position, wherein at the opened position the base is positioned substantially horizontally and spaced above the enclosure and laterally offset from the enclosure, and at the closed position the base is positioned substantially horizontally and on the enclosure and the links overlap longitudinally, and wherein the base remains positioned substantially horizontally at all positions between the opened and the closed positions;

a lifting mechanism connected at one end to the enclosure and connected at an opposing end to the base, the lifting mechanism configured to impose a force opposing a force of gravity on the base in order to supportingly retain the base at a selected position, and;

a concealment object supported upon the base and moved with the base, the concealment object sized to conceal the existence of the underground shelter below when the base is at the closed position.

* * * * *